US011795860B2

(12) United States Patent
Lin et al.

(10) Patent No.: US 11,795,860 B2
(45) Date of Patent: Oct. 24, 2023

(54) EXHAUST GAS TREATMENT ASSEMBLY FOR AN EXHAUST GAS SYSTEM OF AN INTERNAL COMBUSTION ENGINE

(71) Applicant: Purem GmbH, Neunkirchen (DE)

(72) Inventors: Shengxiao Lin, Esslingen (DE); Kirill Karelin, Boeblingen (DE); Alexander Kauderer, Kuchen (DE)

(73) Assignee: Purem GmbH, Neunkirchen (DE)

( * ) Notice: Subject to any disclaimer, the term of this patent is extended or adjusted under 35 U.S.C. 154(b) by 0 days.

(21) Appl. No.: 17/665,008

(22) Filed: Feb. 4, 2022

(65) Prior Publication Data

US 2022/0243639 A1 Aug. 4, 2022

(30) Foreign Application Priority Data

Feb. 4, 2021 (DE) ..... 10 2021 102 551.6
Feb. 26, 2021 (DE) ..... 10 2021 104 678.5

(51) Int. Cl.
*F01N 13/18* (2010.01)
*F01N 3/021* (2006.01)
*F01N 3/28* (2006.01)

(52) U.S. Cl.
CPC ..... *F01N 13/1888* (2013.01); *F01N 3/0211* (2013.01); *F01N 3/2853* (2013.01); *F01N 3/2875* (2013.01); *F01N 3/2878* (2013.01); *F01N 13/1855* (2013.01)

(58) Field of Classification Search
CPC ... F01N 3/0211; F01N 3/2875; F01N 13/0097
See application file for complete search history.

(56) References Cited

U.S. PATENT DOCUMENTS 3,854,888 A * 12/1974 Frietzsche ..... F01N 13/0097 55/482
4,581,206 A * 4/1986 Otani ..... F01N 13/0097 422/171
5,094,073 A 3/1992 Woerner et al.
7,470,301 B2 * 12/2008 Heydens ..... F01N 13/1894 55/502

(Continued)

FOREIGN PATENT DOCUMENTS

DE 39 08 887 A1 9/1990
DE 102013015602 A1 * 3/2015 ..... F01N 13/0097

(Continued)

*Primary Examiner* — Jonathan R Matthias
(74) *Attorney, Agent, or Firm* — Walter Ottesen, P.A.

(57) ABSTRACT

An exhaust gas treatment assembly for an exhaust gas system of an internal combustion engine includes a housing defining a longitudinal axis. A first exhaust gas treatment unit is inserted in the housing and has a first casing and at least one first exhaust gas treatment unit carried in the first casing. A second exhaust gas treatment unit is inserted in the housing and has a second casing and at least one second exhaust gas treatment unit carried therein. A locking arrangement is for locking a first exhaust gas treatment unit in the housing at least against movement in the direction of the longitudinal axis in a locked state, wherein, when the first exhaust gas treatment unit and the second exhaust gas treatment unit are inserted in the housing, the locking arrangement is blocked in the locked state by the second exhaust gas treatment unit.

27 Claims, 5 Drawing Sheets

(56) References Cited

U.S. PATENT DOCUMENTS

| | | | | |
|---|---|---|---|---|
| 2009/0235623 | A1* | 9/2009 | Lerdung | F01N 13/0097 55/502 |
| 2016/0348566 | A1 | 12/2016 | Vyelyayev et al. | |

FOREIGN PATENT DOCUMENTS

| | | | |
|---|---|---|---|
| DE | 10 2015 209 681 | A1 | 12/2016 |
| WO | 2004/113697 | A1 | 12/2004 |
| WO | 2009/096641 | A1 | 8/2009 |

* cited by examiner

EXHAUST GAS TREATMENT ASSEMBLY FOR AN EXHAUST GAS SYSTEM OF AN INTERNAL COMBUSTION ENGINE

CROSS REFERENCE TO RELATED APPLICATIONS

This application claims priority of German patent application nos. 10 2021 102 551.6, filed Feb. 4, 2021, and 10 2021 104 678.5, filed Feb. 26, 2021, the entire contents of which are incorporated herein by reference.

TECHNICAL FIELD

The present disclosure concerns an exhaust gas treatment assembly with a housing and a plurality of exhaust gas treatment units arranged in the housing.

BACKGROUND

In order to clean exhaust gas emitted by an internal combustion engine, it is known to use various exhaust gas treatment units, such as for example catalytic converter units or particle filter units. These are arranged in a housing through which exhaust gas can flow, wherein for efficient exhaust gas cleaning in such a housing, a plurality of exhaust gas treatment units may be arranged successively in the flow direction.

SUMMARY

It is an object of the present disclosure to provide an exhaust gas treatment assembly for an exhaust gas system of an internal combustion engine which, with simple structure, allows the integration of a plurality of exhaust gas treatment units in a housing and the removal of the exhaust gas treatment units from the housing.

According to the disclosure, this object is achieved by an exhaust gas treatment assembly for an exhaust gas system of an internal combustion engine. This exhaust gas treatment assembly includes:

- a housing which is elongate in the direction of the housing longitudinal axis,
- a first exhaust gas treatment unit which is or can be inserted in the housing and has a first casing and at least one first exhaust gas treatment element carried in the first casing,
- a second exhaust gas treatment unit which is or can be inserted in the housing and has a second casing and at least one second exhaust gas treatment unit carried in the second casing,
- a locking arrangement for locking a first exhaust gas treatment unit in the casing at least against movement in the direction of the housing longitudinal axis, in a locked state, wherein when the first exhaust gas treatment unit and the second exhaust gas treatment unit are inserted in the housing, the locking arrangement is blocked in the locked state by the second exhaust gas treatment unit.

With the exhaust gas treatment assembly constructed according to the disclosure, the first exhaust gas treatment unit is locked on the housing by the blocked locking arrangement, even when the second exhaust gas treatment unit is inserted in the housing. The second exhaust gas treatment unit thus secures the first exhaust gas treatment unit to the housing, so that an undefined movement of the first exhaust gas treatment unit relative to the housing cannot occur when both exhaust gas treatment units are inserted in the housing. By removing the second exhaust gas treatment unit from the housing, the blocking of the locking arrangement is eliminated and the first exhaust gas treatment unit can also be removed from the housing, for example in order to clean this or replace it with another first exhaust gas treatment unit.

For a reliable locking arrangement functioning by form fit, this may include:

- at least one lock engagement element provided on the first casing and protruding towards the radial outside,
- at least one lock engagement recess provided on the housing and open towards the radial inside, wherein when the first exhaust gas treatment unit is inserted in the housing, in the locked state, the at least one lock engagement element is positioned so as to engage radially outwardly in a lock engagement recess, and when the second exhaust gas treatment unit is inserted in the housing, is blocked against radially inward movement for eliminating the locked state by the second exhaust gas treatment unit.

In an alternative embodiment, it may be provided that the locking arrangement includes:

- at least one lock engagement element provided on the first casing and having a lock engagement recess open towards the radial outside,
- at least one lock engagement protrusion provided on the housing and protruding towards the radial inside, wherein when the first exhaust gas treatment unit is inserted in the housing, in the locked state, the at least one lock engagement element is positioned with its lock engagement recess surrounding a lock engagement protrusion on the housing, and when the second exhaust gas treatment unit is inserted in the housing, is blocked against radially inward movement for eliminating the locked state by the second exhaust gas treatment unit.

The movement of the first exhaust gas treatment unit in the axial direction when the locked state is created may be suppressed for example in that the at least one lock engagement recess on the housing is provided by an axially delimited bulge of the housing towards the radial outside. Such a bulge may be provided for example in that locally, in the region of a lock engagement recess, the wall thickness of a wall of the housing decreases or a wall of the housing is deformed radially outward.

If a lock engagement recess is provided on the housing, running substantially completely around in the circumferential direction, the process of inserting the first exhaust gas treatment unit in the housing can be performed particularly easily since there is no need to observe a defined rotary positioning of the first exhaust gas treatment unit relative to the housing.

In an alternative embodiment in which, in addition, the first exhaust gas treatment unit can be reliably secured on the housing against rotation about the housing longitudinal axis, a plurality of lock engagement recesses, arranged circumferentially spaced apart from one another and delimited in the circumferential direction, may be provided on the housing.

In order to guarantee an effect of the locking arrangement which is evenly distributed over the circumference, it is proposed that a plurality of lock engagement elements, arranged circumferentially spaced apart from one another, is provided on the first casing.

For a reliably functioning construction which is simple to implement, each lock engagement element includes a fixing portion fixedly provided on the first casing, a blocking portion which, when the second exhaust gas treatment unit is inserted in the housing, in the locked state, is blocked against movement towards the radial inside and/or is loaded towards the radial outside by the second casing, and a locking portion which, in the locked state, engages in a lock engagement recess on the housing.

In the alternative embodiment described above with lock engagement recesses on the lock engagement element and one or more lock engagement protrusions on the housing, each lock engagement element includes a fixing portion fixedly provided on the first casing, a blocking portion which, when the second exhaust gas treatment unit is inserted in the housing, in the locked state, is blocked against movement towards the radial inside and/or is loaded towards the radial outside by the second casing, and a locking portion with a lock engagement recess which, in the locked state, surrounds a lock engagement protrusion on the housing.

The locking effect of the locking arrangement may be improved, with simultaneous avoidance of rattling noises, if in the locked state, the blocking portion, which is loaded towards the radial outside by means of the second casing, of the locking portion is held in contact with the housing, for example, is held in the region of a lock engagement recess receiving a locking portion.

A reliable interaction of the second exhaust gas treatment unit with the locking arrangement for blocking this in the locked state may be guaranteed in that the housing has an insertion opening for receiving the first exhaust gas treatment unit and the second exhaust gas treatment unit into the housing by movement in an insertion direction, wherein the first exhaust gas treatment unit has a first end portion which leads on movement of the first exhaust gas treatment unit in the insertion direction for insertion in the housing, and a second end portion which trails on movement of the first exhaust gas treatment unit in the insertion direction for insertion into the housing, and the at least one lock engagement element is provided on the first casing in the region of the second end portion of the first exhaust gas treatment unit.

Here a defined holding of the first exhaust gas treatment unit in the housing over its entire length can be achieved if, when the first exhaust gas treatment unit is inserted in the housing, the first casing in the region of the first end portion of the first exhaust gas treatment unit is radially supported and/or sealed relative to the housing by a support/sealing arrangement.

For blocking interaction with the locking arrangement, the second exhaust gas treatment unit may have a first end portion which leads on movement of the second gas treatment unit in the insertion direction for insertion in the housing, and a second end portion which trails on movement of the second exhaust gas treatment unit in the insertion direction for insertion into the housing, and in the locked state, the at least one lock engagement element may be blocked in the locked state by the second casing in the region of the first end portion of the second exhaust gas treatment unit.

With a configuration in which the lock engagement elements can be optimally adapted to the locking function they must fulfil, at least one lock engagement element, preferably each lock engagement element, is fixed to the first casing as a separate component, and/or at least one lock engagement element, preferably each lock engagement element, is made of sheet metal material. Alternatively, a plurality of lock engagement elements may be provided on a preferably ring-like lock engagement element carrier fixed to the first casing. In a further alternative embodiment, at least one lock engagement element may be configured as an integral part of the first casing and be arranged extending radially outward therefrom.

For simple insertion of the first exhaust gas treatment unit in the housing and removal thereof from the housing, it is proposed that when the first exhaust gas treatment unit is inserted in the housing, and the second exhaust gas treatment unit is not inserted in the housing, the locking arrangement is not in the locked state, and can be brought into the locked state by insertion of the second exhaust gas treatment unit into the housing. Alternatively, to achieve a holding of the first exhaust gas treatment unit in the housing while the second exhaust gas treatment unit is not yet inserted in the housing, when the first exhaust gas treatment unit is inserted in the housing and the second exhaust gas treatment unit is not inserted in the housing, the locking arrangement may be in the locked state.

To ensure that the exhaust gas treatment assembly remains held together in stable fashion, it is proposed that when the second exhaust gas treatment unit is inserted in the housing, the second exhaust gas treatment unit is or can be fixed relative to the housing by at least one fixing element, preferably screw bolts.

With the exhaust gas treatment assembly according to the disclosure, at least one exhaust gas treatment unit may include a catalytic converter unit, such as for example an oxidation catalytic converter unit or diesel oxidation catalytic converter unit, and/or that at least one exhaust gas treatment unit may include a particle filter unit, such as for example a diesel particulate filter unit. Furthermore, at least one exhaust gas treatment unit may include a preferably electrically operated heater unit.

The disclosure furthermore concerns a method for constructing an exhaust gas treatment assembly according to the disclosure, including the measures:

a) providing the housing, the first exhaust gas treatment unit and the second exhaust gas treatment unit as separate components,
b) inserting the first exhaust gas treatment unit in the housing such that the locking arrangement enters or can be brought into the locked state,
c) inserting the second exhaust gas treatment unit into the housing such that the locking arrangement is blocked in the locked state by the second exhaust gas treatment unit.

To ensure that the exhaust gas treatment assembly can be held together in stable fashion, the method may include a measure d) for fixing the second exhaust gas treatment unit relative to the housing in a state blocking the locking arrangement in the locked state after performance of measure c).

In order for example to obtain access to the first exhaust gas treatment unit for maintenance or exchange thereof, the method may furthermore include a measure e) for exchanging the first exhaust gas treatment unit received in the housing. This measure e) includes removing the second exhaust gas treatment unit from the housing, and in so doing, eliminating the state blocking the locking arrangement in the locked state, and removing the first exhaust gas treatment unit from the housing.

The disclosure furthermore concerns an exhaust gas system for an internal combustion engine, in particular in a vehicle, including at least one exhaust gas treatment assembly constructed according to the disclosure.

In such an exhaust gas system, the housing may be fixed to a wall of an exhaust gas-carrying component preferably by welding, and when the second exhaust gas treatment unit is inserted in the housing, the second exhaust gas treatment unit may be fixed to the wall.

BRIEF DESCRIPTION OF THE DRAWINGS

The invention will now be described with reference to the drawings wherein.

DESCRIPTION OF THE PREFERRED EMBODIMENTS

Figure 1:
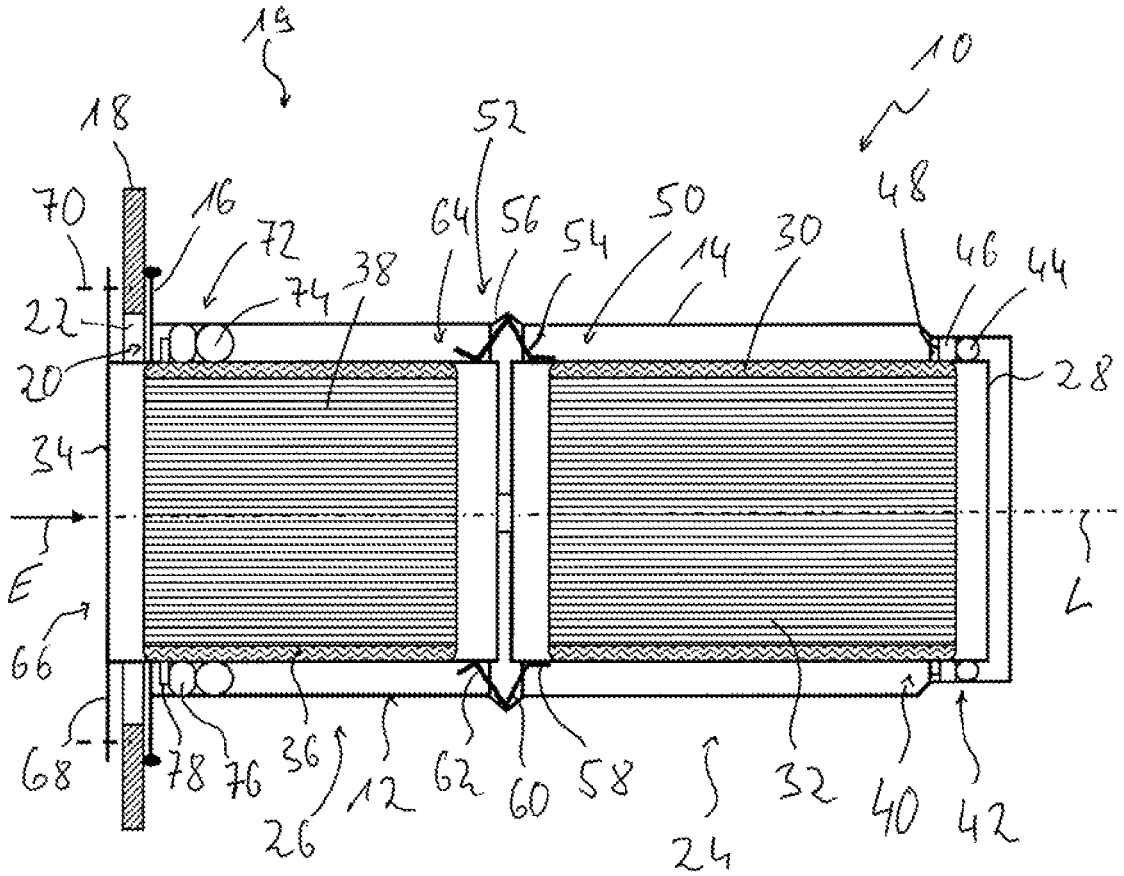
FIG. 1 is a general, longitudinal sectional schematic of an exhaust gas treatment assembly for an exhaust gas system of an internal combustion engine, with two exhaust gas treatment units inserted in a housing.

FIG. 1 shows an exhaust gas treatment assembly for an exhaust gas system of an internal combustion engine, for example in a vehicle, generally designated 10. The exhaust gas treatment assembly includes a tubular housing 12 which is elongate in the direction of the housing longitudinal axis L and for example made of sheet metal material. In an end region of the housing 12, shown on the left in FIG. 1, a connecting flange region 16 protrudes towards the radial outside from a housing wall 14, formed so as to be substantially cylindrical in long length regions, by means of which the housing 12 can be fixed, for example by welding, to a floor or wall 18 of an exhaust gas-carrying housing or an exhaust gas-carrying component of an exhaust gas system 19.

In this end region of the housing 12 shown on the left in FIG. 1 and attached to the wall 18, the housing has an insertion opening 20 which is aligned with an opening 22 in the wall 18, so that in the manner to be described below, a first exhaust gas treatment unit 24 and a second exhaust gas treatment 26 can be inserted through the opening 22 and the insertion opening 20 into the housing 12.

The first exhaust gas treatment unit 24 includes, for example, a tubular first casing 28, formed so as to be substantially cylindrical, in which for example a first exhaust gas treatment element 32 is held by means of a fiber matting 30 or similar. The first exhaust gas treatment element 32 may for example include a monolithic, porous body through which exhaust gas can flow and which may be made from and/or coated with catalytically active material.

Similarly, the second exhaust gas treatment unit 26 includes a substantially tubular or cylindrical second casing 34, which like the first casing 28 may be made from sheet metal material, and in which a second exhaust gas treatment element 38 may be carried, for example with the interposition of a fiber mat 36. The second exhaust gas treatment element 38 may also include a porous, for example monolithic body through which exhaust gas may flow and which may be made from and/or coated with catalytically active material.

The first exhaust gas treatment unit 24 has a first end portion 40 (shown on the right in FIG. 1) which leads when the first exhaust gas treatment unit 24 is inserted in the housing 12 through the insertion opening 20 in an insertion direction E, and which, when the first exhaust gas treatment unit 24 is completely introduced into the housing 12, is supported and sealed relative to the housing 12, for example in an end portion with reduced radial dimension, by means of a support/sealing arrangement 42. The support/sealing arrangement 42 includes an O-ring-like sealing element 44 which creates a gas-tight closure between the first casing 28 and the housing 12, and a radial support element 46 which provides a defined radial support of the first casing 28 relative to the housing 12, and thus ensures that the sealing element 44 is protected from excessive radial load. Furthermore, the support/sealing arrangement 42 includes, for example, a ring-like axial support element 48, which is fixed to the outer periphery of the first casing 28 for example by welding and on which the radial support element 46 and the sealing element 44 are axially supported against the insertion direction E, and thus held in defined positions on the first casing 28 on insertion of the first exhaust gas treatment unit 24 in the insertion direction E.

In the region of a second end portion 50 of the first exhaust gas treatment unit 24 which trails on insertion of the first exhaust gas treatment unit 24 into the housing 12 in the insertion direction E, this is held in a defined axial position in the housing 12 by means of a locking arrangement, generally designated 52, in the assembled state shown in FIG. 1, in which both exhaust gas treatment units 24, 26 are inserted in the housing 12. The locking arrangement 52 includes a plurality of lock engagement elements 54, preferably arranged with even circumferential spacing from one another about the housing longitudinal axis L, and a lock engagement recess 56 running completely around the housing longitudinal axis L in the embodiment shown. The lock engagement recess 56 is open towards the radial inside, that is, towards a housing interior, and may be provided for example by deforming the wall 14 of the housing 12 made of sheet metal material. Alternatively, the lock engagement recess 56 may be provided in that the wall thickness of the wall 14 of the housing 12 is reduced in the region of this lock engagement recess 56.

Each of the lock engagement elements 54, which are made for example from sheet metal material and hence are fundamentally elastically deformable or flexible, is fixed by a fixing portion 58 to the first casing 28 in the region of the second end portion 50 of the first exhaust gas treatment unit 24. This may be achieved for example by material bonding, such as, for example, soldering or welding, or by a fixing element such as, for example, a fixing rivet or several fixing rivets or similar. Alternatively, at least one or each of the lock engagement elements 54 may form an integral part of the first casing 28, and extend towards the radial outside starting from a region of the integral connection to the first casing 28 which provides the fixing portion 58.

In the embodiment shown in FIG. 1, in which the lock engagement elements 54 are formed as components produced separately from the first casing 28 and attached thereto, the elements extend, starting from their fixing portion 58, with a locking portion 60 towards the radial outside, wherein in the locked state shown in FIG. 1, the locking portion 60 is positioned so as to engage in the lock engagement recesses 56 of the housing 12 and thus prevent an axial movement of the first exhaust gas treatment unit 24 in the housing 12 by a form fit acting in the direction of the housing longitudinal axis L. Here preferably, a radially outer crown region of the blocking portion 60 lies in a respective crown region of the lock engagement recess 56 and is firmly in contact with the housing 12, so that even slight movements of the first exhaust gas treatment unit 24 in the direction of the housing longitudinal axis L are suppressed, and there is no knocking or rattling thereof against the housing 12 caused by vibrations of the lock engagement elements 54.

The lock engagement elements 54 furthermore include a blocking portion 62 which comes into or stands in interaction with the second casing 34 of the second exhaust gas treatment unit 26. In the state shown in FIG. 1, in which the locking arrangement 52 is in the locked state and hence the locked state cannot be released, the blocking portions 62 of the lock engagement elements 54 lie on the second casing 34 in the region of a first end portion 64 of the second exhaust gas treatment unit 26, which leads on insertion of the second exhaust gas treatment unit 26 in the insertion direction E, and are thus blocked against movement towards the radial inside or are loaded towards the radial outside by the second casing 34, so as to achieve and retain the above-described state in which the lock engagement elements 54 are held by the crown regions of their locking portions 60 in contact with the crown region of the lock engagement recess 56.

In order, in the assembled state of the exhaust gas treatment assembly 10, to also hold the second exhaust gas treatment unit 26 in a defined position, in particular in a position in which this blocks the locking arrangement 52 against eliminating the locked state, on the second casing 34, in an end portion 66 of the second exhaust gas treatment unit 26 which trails on insertion of the second exhaust gas treatment unit 26 in the insertion direction E, a flange-like, radially outwardly protruding fixing portion 68 is provided, by means of which the second exhaust gas treatment unit 26 may be fixed with respect to the housing 12, for example by the use of generically illustrated fixing element 70, such as, for example, screw bolts. Such fixing elements 70 may be introduced for example into assigned openings of the wall 18.

In order to achieve a gas-tight closure of the second exhaust gas treatment unit 26 relative to the housing 12, a support/sealing arrangement 72 is also assigned to this. This too includes, for example, an O-ring-like sealing element 74, a radial support element 76, and, for example, a ring-like axial support element 78 which is fixed to the outer periphery of the second casing 34, for example by welding or soldering, and which holds the sealing element 74 and radial support element 76 in defined positions relative to the second casing 34 against the insertion direction E on insertion of the second exhaust gas treatment unit 26 into the housing 12.

Figure 2:
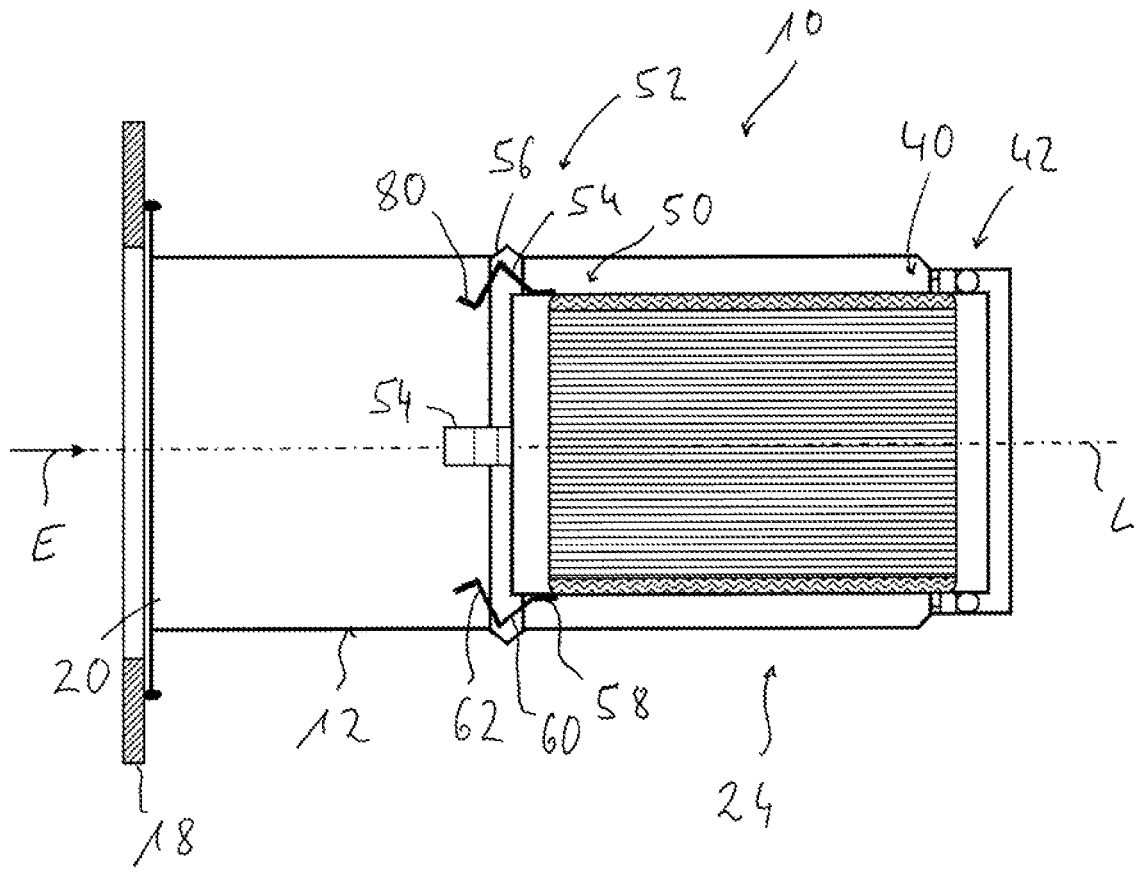
FIG. 2 shows the exhaust gas treatment assembly from FIG. 1 with only a first exhaust gas treatment unit in the housing.

On assembly of the exhaust gas treatment assembly 10, firstly the first exhaust gas treatment unit 24 is inserted into the housing 12 through the insertion opening 20 in the insertion direction E. The state in which the first exhaust gas treatment unit 24 is inserted into the housing 12, but the second exhaust gas treatment unit 26 is not yet inserted into the housing 12, is shown in FIG. 2. In the embodiment of the first exhaust gas treatment unit 24 shown in FIG. 2, the locking arrangement 52 or lock engagement elements 54 are configured such that they do not engage with their locking portions 60 in the lock engagement recess 56. This means that on insertion of the first exhaust gas treatment unit 24, the blocking portions 60 of the lock engagement elements 54 do not slide along the inner surface of the wall 14 of the housing 12.

On subsequent insertion of the second exhaust gas treatment unit 26, this, with the second casing 34 in the first end portion 64, comes into contact with blocking portions 62 of the lock engagement elements 54. In order to provide an insertion chamfer of the lock engagement elements 54, the latter may be formed in the region of the blocking portion 62 with oblique insertion end portions 80 extending towards the radial outside opposite the insertion direction E.

In the course of the insertion movement of the second exhaust gas treatment unit 26, this loads the insertion end portions 80 and thus presses the lock engagement elements 54 with their locking portions 60 towards the radial outside, so that they come into engagement in the lock engagement recess 56 and are held in contact with the housing 12 in the region of the lock engagement recess 56. Then the second exhaust gas treatment unit 26 may be fixed by the fixing element 70 to the wall 18, and hence with respect to the housing 12 carried thereon. Since in this state, the lock engagement elements 54 in the region of their blocking portions 62 are blocked against movement towards the radial inside, or are loaded in the direction towards the radial outside for engagement into the lock engagement recess 56, the locking arrangement 52 is blocked in its locked state and hence the first exhaust gas treatment unit 24 is held in a defined axial position on the housing 12. In particular, thereby also in the second end portion 50 of the first exhaust gas treatment unit 24, a defined radial support of the first exhaust gas treatment unit 24 relative to the housing 12 is achieved. In this state, the lock engagement elements 54 can at least support the defined radial holding of the second exhaust gas treatment 26 in its first end portion 64.

Since the lock engagement elements 54 are loaded in contact against the housing 12 by the second exhaust gas treatment unit 26, an interference fit exists between the lock engagement elements 54 and the housing 12, so that, also supported by the interference fit generated in the region of the support/sealing arrangement 42, the first exhaust gas treatment unit 24 is held in the housing 12 securely against rotation about the housing longitudinal axis L. In order to provide an additional rotational security, instead of the lock engagement recess 56 running completely around in the circumferential direction, a plurality of lock engagement recesses may be provided which are arranged spaced apart from one another in the circumferential direction, wherein for example then a lock engagement recess limited in the circumferential direction may be assigned for example to each lock engagement element 54, and also a form fit acting in the circumferential direction can be achieved between the lock engagement elements 54, engaging in a respective lock engagement recess, and the housing 12.

Figure 3:
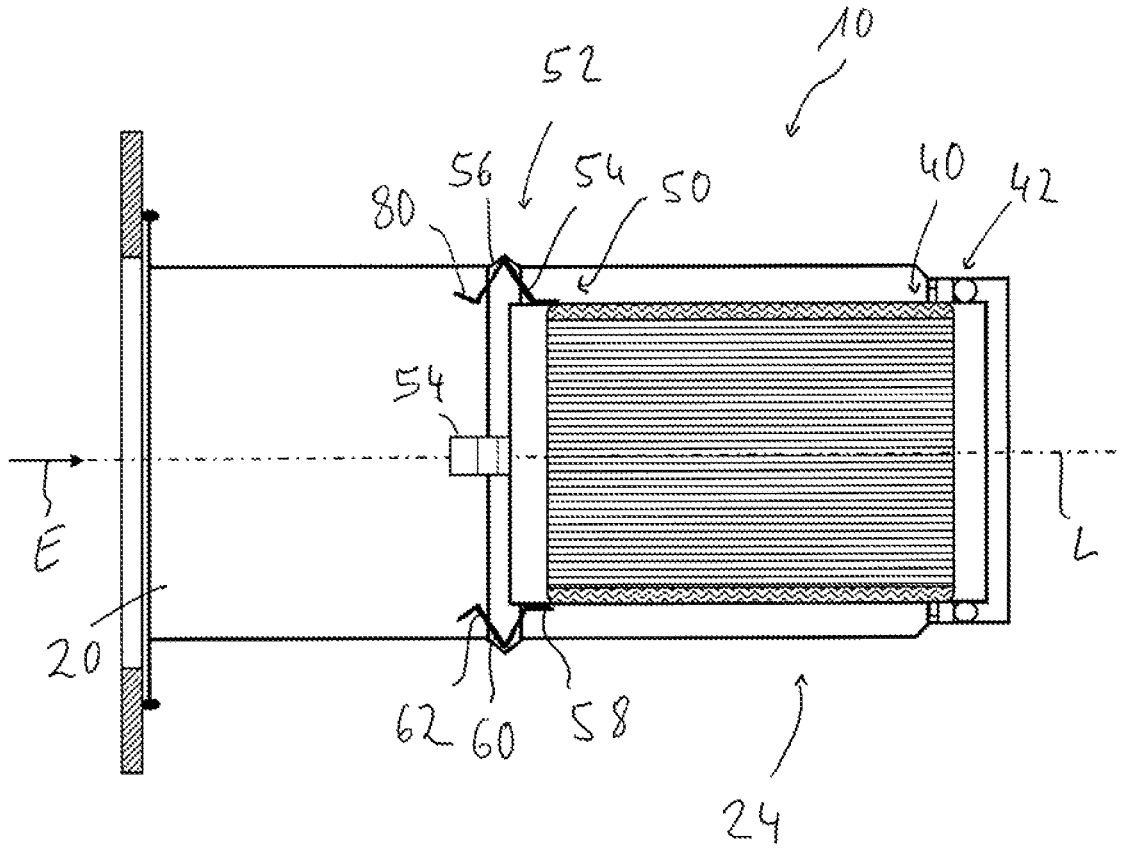
FIG. 3 is a schematic corresponding to FIG. 2 with an alternative embodiment of the first exhaust gas treatment unit inserted in the housing.

An alternative embodiment in particular of the first exhaust gas treatment unit 24 is shown in FIG. 3. In a state in which the first exhaust gas treatment unit 24 is inserted in the housing 12, but the second exhaust gas treatment unit 26 is not inserted in the housing, the locking arrangement 52 is already in the locked state since the lock engagement elements 54, because of their configuration, are already positioned engaging in the lock engagement recess 56. The subsequent insertion of the second exhaust gas treatment unit 26 means that, when this has been completely inserted in the housing 12, the lock engagement elements 54 already engaging in the lock engagement recess 56 are blocked by the second casing 34 against movement for disengaging from the lock engagement recess 56. In this state for example, it may be provided that, purely because of the configuration and hence preload of the lock engagement elements 54, these with their locking portions 60 are held in contact with the housing 12 in the region of the lock engagement recess 56. It is not absolutely necessary that in this state, the blocking portions 62 are already in contact with the second casing 34 or loaded thereby towards the radial outside. The distance between the blocking portions 62 and the second casing 34 must however be dimensioned such that on movement of the blocking portions 62 towards the radial inside, the locking portions 60 cannot come out of engagement with the lock engagement recess 56. Alternatively, in this embodiment too, it may be provided that when the second exhaust gas treatment unit 26 is inserted in the housing 12, the casing 34 thereof loads the blocking portion 62 of the lock engagement elements 54 towards the radial outside, and hence presses the lock engagement elements 54 with their locking portions 60 against the housing 12 in the region of the lock engagement recess 56.

With the structure of an exhaust gas treatment assembly 10 according to the disclosure, which structurally simple configuration it is possible to hold several exhaust gas treatment units 24, 26 reliably in defined positions in the housing 12 and have easy access thereto, for example in order to clean or exchange these. In particular, to achieve access to the first exhaust gas treatment unit 24, the second exhaust gas treatment unit 26 may be removed from the housing 12, so that also the first exhaust gas treatment unit 24 can be extracted from the housing 12 when the locking arrangement 52 is no longer blocked in the locked state.

It is pointed out that with such an exhaust gas treatment assembly 10, more than two exhaust gas treatment units may also be used. Thus for example, with a correspondingly longer configuration of the housing 12, a further exhaust gas treatment unit may be positioned to the right of the first exhaust gas treatment unit in FIG. 1. This further exhaust gas treatment unit may also have an assigned locking arrangement 52 as shown in FIG. 1. This locking arrangement 52 may then be blocked in this locked state by the first exhaust gas treatment unit 24, while again the locking arrangement 52 of the first exhaust gas treatment unit 24 may be blocked in its locked state by the second exhaust gas treatment unit 26.

Figure 4:
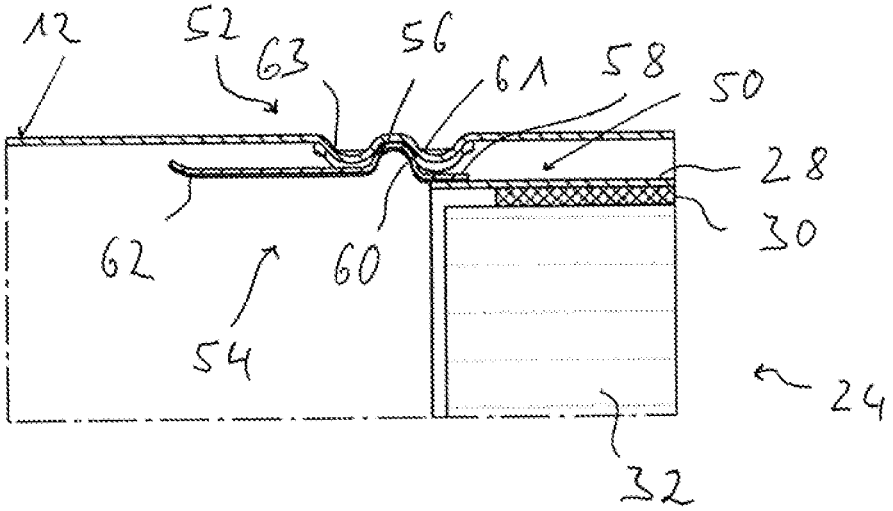
FIG. 4 is a detail view of an exhaust gas treatment assembly with an alternative embodiment of a locking arrangement.

An alternative embodiment of the locking arrangement 52, in particular with respect to the provision of the lock engagement recess 56, is shown in FIG. 4. The lock engagement recess 56 which is open towards the inside is provided on the housing 12 in that deformations 61, 63 of the housing are provided, which are axially spaced from one another and directed radially inward, for example running completely around in the circumferential direction or limited in the circumferential direction, and which between them form the radially inwardly open lock engagement recess 56 for receiving a lock engagement element 54. Thus radially outwardly directed deformations which locally enlarge the diameter of the housing may be substantially avoided.

Figure 5:
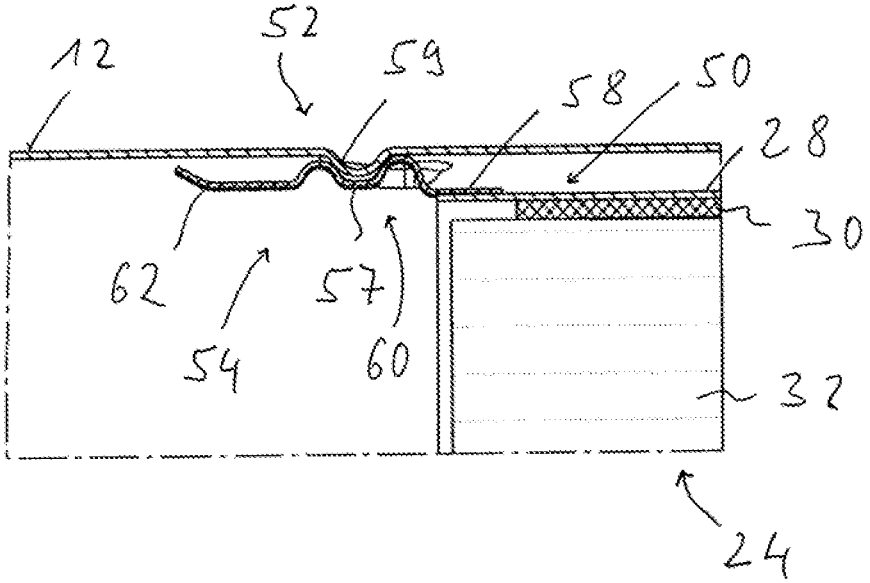
FIG. 5 is a further detail view of an exhaust gas treatment assembly with an alternative embodiment of a locking arrangement; and, FIG. 6 shows a plurality of locking elements of a locking arrangement carried by a ring-like carrier.

A further alternative embodiment of the locking arrangement 52 is shown in FIG. 5. In this embodiment, a lock engagement protrusion 59 is provided, for example, produced by forming and directed radially inwardly or protruding radially outwardly, for example running completely around in the circumferential direction or provided by portions limited in the circumferential direction. Complementary to this, on each locking element 54, a radially outwardly open lock engagement recess 56 is formed for example between two rib-like bulges. In the locked state, the locking element 54, preloaded for example towards the radial outside or loaded towards the radial outside by the second exhaust gas treatment unit 26, in the region of its radially outwardly open lock engagement recess 57, surrounds the or a lock engagement protrusion 59 protruding radially inwardly on the housing 12, whereby the first exhaust gas treatment unit 24 is axially fixed with respect to the housing 12, and when the second exhaust gas treatment unit 26 is inserted in the housing 12, is also blocked against release in this state.

It is pointed out that the variants shown in FIGS. 4 and 5 may evidently be implemented in combination with the various action mechanisms, shown in FIGS. 2 and 3, of the locking elements 54 in order to achieve the locked state.

Figure 6:
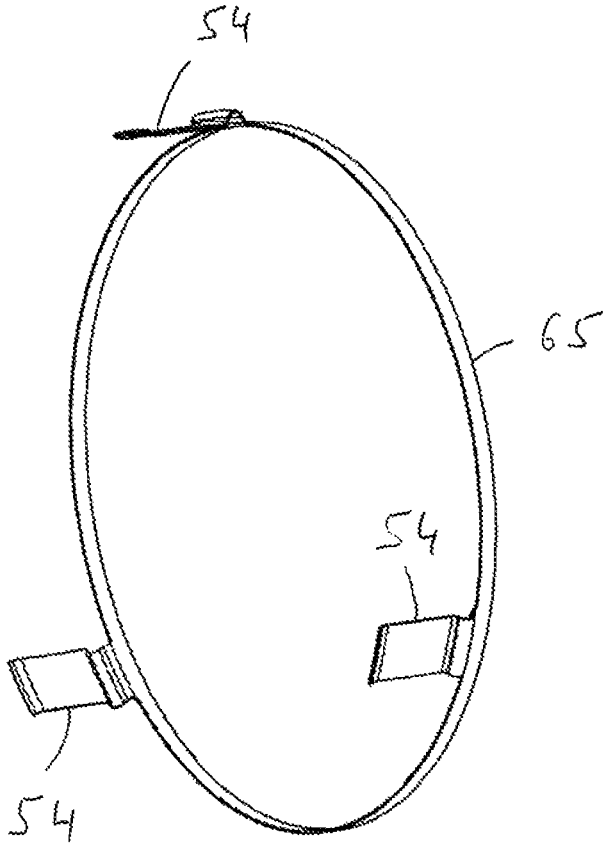

An alternative embodiment for connecting the locking elements 54 to the first casing 28 is shown in FIG. 6. In this embodiment, the locking elements 54 are provided for example as an integral part of a ring-like locking element carrier 65, formed for example from sheet metal material. The locking element carrier 65 may be fixed in the region of the second end portion 50 of the first exhaust gas treatment unit 24 on the first casing 28, for example surrounding this on the outside or inserted therein, whereby all locking elements 54 may be fixedly attached to the first casing 28.

With the embodiment of an exhaust gas treatment assembly according to the disclosure, a simple and reliable locking or fixing of the exhaust gas treatment unit is achieved, wherein in addition, because of the flexibility in the region of the lock engagement elements, production tolerances and thermal expansions in both the axial and radial directions can be compensated. In addition, the lock engagement elements may also be used as handles when handling the first exhaust gas treatment unit.

In such an exhaust gas treatment assembly, the various exhaust gas treatment units may perform different functions depending on their configuration. Thus for example both exhaust gas treatment units may be formed as catalytic converter units. Alternatively, one of the exhaust gas treatment units may be configured as a catalytic converter unit and the other a particle filter unit. In the further alternative, one of the exhaust gas treatment units may be a heater unit, for example, powered by electrical energy, through which heat can be introduced into the exhaust gas stream or an exhaust gas treatment element, and hence exhaust gas treatment achieved in the form of heating. For example, a combination of an exhaust gas treatment unit configured as a catalytic converter unit and an exhaust gas treatment unit configured as a heating unit may be provided. Alternatively, a combination of an exhaust gas treatment unit configured as a heater unit and an exhaust gas treatment unit configured as a particle filter unit may be implemented. In a further alternative, an exhaust gas treatment unit could contain, as well as an exhaust gas treatment element effective for example as a catalytic converter or particle filter, also a heater element which may be, for example, electrically energized, so that this exhaust gas treatment unit may be active both as a heater unit and also as a catalytic converter unit or particle filter unit. It is evident that for the configuration of an exhaust gas treatment unit as an electrically operated heater unit, a line passage must be provided through the housing for the supply of electrical energy to a heating element, for example a casing heating conductor.

It is understood that the foregoing description is that of the preferred embodiments of the invention and that various changes and modifications may be made thereto without departing from the spirit and scope of the invention as defined in the appended claims.

What is claimed is:

1. An exhaust gas treatment assembly for an exhaust gas system of an internal combustion engine, the exhaust gas treatment assembly comprising:

a housing defining a longitudinal axis (L) and said housing being elongated along said longitudinal axis (L);

a first exhaust gas treatment unit inserted into said housing;

said first exhaust gas treatment unit including a first casing and at least one first exhaust gas treatment element carried in said first casing;

a second exhaust gas treatment unit inserted into said housing;

said second exhaust gas treatment unit including a second casing and at least one second exhaust gas treatment element carried in said second casing;

a locking arrangement configured to lock said first exhaust gas treatment unit in a locked state in said housing at least against movement along said longitudinal axis (L); and, said locking arrangement being further configured to be blocked in said locked state by said second exhaust gas treatment unit when said first exhaust gas treatment unit and said second exhaust gas treatment unit are inserted into said housing.

2. The exhaust gas treatment assembly of claim 1, wherein said locking arrangement further comprises:

at least one lock engagement element on said first casing protruding radially outward;

said housing having at least one lock engagement recess formed therein so as to open radially inwardly; and, when said first exhaust gas treatment unit is inserted in said housing in said locked state, said at least one lock engagement element is positioned so as to engage radially outwardly in said lock engagement recess, and when said second exhaust gas treatment unit is inserted into said housing, said at least one lock engagement element is blocked against radially inward movement for lifting said locked state by said second exhaust gas treatment unit.

3. The exhaust gas treatment assembly of claim 2, wherein said at least one lock engagement recess on said housing is formed by an axially delimited bulge on said housing directed radially outwardly.

4. The exhaust gas treatment assembly of claim 2, wherein said at least one lock engagement recess runs substantially completely around in circumferential direction on said housing.

5. The exhaust gas treatment assembly of claim 2, wherein a plurality of said lock engagement recesses are arranged on said housing and are circumferentially spaced apart from one another and delimited in circumferential direction.

6. The exhaust gas treatment assembly of claim 5, wherein a plurality of said lock engagement elements are arranged circumferentially spaced apart from one another on said first casing.

7. The exhaust gas treatment assembly of claim 6, wherein each of said lock engagement elements includes:

a fixing portion fixedly provided on said first casing;

a locking portion; and, a blocking portion which, when said second exhaust gas treatment unit is inserted in said housing, in said locked state, whereupon at least one of the following applies: each one of said locking engagement elements is blocked against movement toward the radial inside; and, each one of said locking engagement elements is loaded toward the radial outside by said second casing and said locking portion which, in said locked state, engages in a corresponding one of said lock engagement recesses on said housing.

8. The exhaust gas treatment assembly of claim 7, wherein in said locked state, said blocking portion, which is loaded radially outwardly by said second casing, is held in contact with said housing.

9. The exhaust gas treatment assembly of claim 6, further comprising a ring-like lock engagement element carrier mounted on said first casing; and, said plurality of lock engagement elements being provided on said ring-like lock engagement element carrier.

10. The exhaust gas treatment assembly of claim 9, wherein said lock engagement elements are made of sheet metal.

11. The exhaust gas treatment assembly of claim 2, wherein:

said housing has an insertion opening for receiving said first exhaust gas treatment unit and said second exhaust gas treatment unit into said housing by movement in an insertion direction (E);

said first exhaust gas treatment unit has a first end portion which leads on movement of said first exhaust gas treatment unit in said insertion direction (E) for insertion in said housing and a second end portion which trails on movement of said first exhaust gas treatment unit in said insertion direction (E) for insertion into said housing; and, said at least one lock engagement element is provided on said first casing in the region of said second end portion of said first exhaust gas treatment unit.

12. The exhaust gas treatment assembly of claim 11, further comprising a support/sealing arrangement for supporting and sealing said first casing in the region of said first end portion of said first exhaust gas treatment unit relative to said housing when said first exhaust gas treatment unit is inserted into said housing.

13. The exhaust gas treatment assembly of claim 11, wherein said second exhaust gas treatment unit has a first end portion which leads on movement of said second gas treatment unit in the insertion direction (E) for insertion in said housing and a second end portion which trails on movement of said second exhaust gas treatment unit in the insertion direction (E) for insertion into said housing; and, in said locked state, at least one lock engagement element is blocked in said locked state by said second casing in the region of said first end portion of said second exhaust gas treatment unit.

14. The exhaust gas treatment assembly of claim 2, wherein said at least one lock engagement element is fixed to said first casing as a separate component.

15. The exhaust gas treatment assembly of claim 2, wherein said at least one lock engagement recess on said housing is defined by two mutually adjacent bulges of said housing arranged axially spaced apart from one another and directed radially inwardly.

16. The exhaust gas treatment assembly of claim 1, wherein, when the first exhaust gas treatment unit is inserted in the housing and the second exhaust gas treatment unit is not inserted in the housing, said locking arrangement is not in said locked state and can be brought into said locked state by insertion of the second exhaust gas treatment unit into said housing; or, when said first exhaust gas treatment unit is inserted in said housing and said second exhaust gas treatment unit is not inserted in the housing, said locking arrangement is in said locked state.

17. The exhaust gas treatment assembly of claim 1, further comprising fixing elements including threaded fasteners for fixing said second exhaust gas treatment unit relative to said housing after said second exhaust gas treatment unit is inserted into said housing.

18. The exhaust gas treatment assembly of claim 1, wherein at least one of said first and second exhaust gas treatment units includes at least one of a catalytic converter and a particle filter and an electrically operated heater unit.

19. The exhaust gas treatment assembly of claim 1, wherein said locking arrangement further comprises:

at least one lock engagement element provided on said first casing and having a lock engagement recess open in a radially outward direction;

at least one lock engagement protrusion provided on said housing and configured to protrude radially inwardly;

when said first exhaust gas treatment unit is inserted into said housing, in said blocked state, said at least one lock engagement element is positioned with said lock engagement recess thereof surrounding said lock engagement protrusion on said housing; and, when said second exhaust gas treatment unit is inserted into said housing, said at least one lock engagement element is blocked against radially inward movement for lifting said locked state by said second exhaust gas treatment unit.

20. The exhaust gas treatment assembly of claim 19, wherein each of said lock engagement elements includes:

a fixing portion fixedly provided on said first casing;

a locking portion; and, a blocking portion which, when the second exhaust gas treatment unit is inserted into said housing, in the locked state, is blocked against movement radially inwardly or is loaded radially outwardly by said second casing; and, said locking portion with a lock engagement recess surrounds a lock engagement protrusion, in said locked state, on said housing.

21. The exhaust gas treatment assembly of claim 19, wherein said lock engagement protrusion runs substantially completely around said housing in circumferential direction.

22. The exhaust gas treatment assembly of claim 19, wherein a plurality of said lock engagement protrusions are provided on said housing; and, said plurality of protrusions are arranged circumferentially spaced apart from one another and are delimited in circumferential direction.

23. A method for building an exhaust gas treatment assembly which includes a housing defining a longitudinal axis (L) and said housing being elongated along said longitudinal axis (L); a first exhaust gas treatment unit inserted into said housing; said first exhaust gas treatment unit including a first casing and at least one first exhaust gas treatment element carried in said first casing; a second exhaust gas treatment unit inserted into said housing; said second exhaust gas treatment unit including a second casing and at least one second exhaust gas treatment element carried in said second casing; a locking arrangement configured to lock said first exhaust gas treatment unit in a locked state in said housing at least against movement along said longitudinal axis (L); and, said locking arrangement being further configured to be blocked in said locked state by said second exhaust gas treatment unit when said first exhaust gas treatment unit and said second exhaust gas treatment unit are inserted into said housing, the method comprising the steps of:

providing the housing, the first exhaust gas treatment unit and the second exhaust gas treatment unit as separate components;

inserting the first exhaust gas treatment unit in the housing such that the locking arrangement enters or can be brought into the locked state; and, inserting the second exhaust gas treatment unit into the housing such that the locking arrangement is blocked in the locked state by the second exhaust gas treatment unit.

24. The method of claim 23, further comprising fixing the second exhaust gas treatment unit relative to the housing in a state blocking the locking arrangement in the locked state.

25. The method of claim 23, further comprising exchanging the first exhaust gas treatment unit received in the housing by removing the second exhaust gas treatment unit from the housing and in so doing, lifting the state blocking the locking arrangement in the locked state and removing the first exhaust gas treatment unit from the housing.

26. An exhaust gas system for an internal combustion engine including an internal combustion engine for a vehicle, said exhaust gas system comprising:

at least one exhaust gas treatment assembly including:

a housing defining a longitudinal axis (L) and said housing being elongated along said longitudinal axis (L);

a first exhaust gas treatment unit inserted into said housing;

said first exhaust gas treatment unit including a first casing and at least one first exhaust gas treatment element carried in said first casing;

a second exhaust gas treatment unit inserted into said housing;

said second exhaust gas treatment unit including a second casing and at least one second exhaust gas treatment element carried in said second casing;

a locking arrangement configured to lock said first exhaust gas treatment unit in a locked state in said housing at least against movement along said longitudinal axis (L); and, said locking arrangement being further configured to be blocked in said locked state by said second exhaust gas treatment unit when said first exhaust gas treatment unit and said second exhaust gas treatment unit are inserted into said housing.

27. The exhaust gas system of claim 26, wherein the housing is fixed to a wall of an exhaust gas-carrying component by welding and when the second exhaust gas treatment unit is inserted in said housing, the second exhaust gas treatment unit is fixed to said wall.

* * * * *